United States Patent [19]

Toramoto et al.

[11] Patent Number: 4,859,197

[45] Date of Patent: Aug. 22, 1989

[54] PIN PLUG CONNECTOR

[75] Inventors: Hisao Toramoto, Nara; Tadashi Yagi, Higashiosaka, both of Japan

[73] Assignee: Hosiden Electronics Co., Ltd., Osaka, Japan

[21] Appl. No.: 189,917

[22] Filed: May 3, 1988

[30] Foreign Application Priority Data

Jul. 7, 1987 [JP] Japan ..... 62-104697[U]

[51] Int. Cl.[4] ..... H01R 17/04

[52] U.S. Cl. ..... 439/675; 439/849; 439/746

[58] Field of Search ..... 439/877, 879, 891, 578–585, 439/675, 607, 610, 746, 849

[56] References Cited

U.S. PATENT DOCUMENTS

| | | | |
|---|---|---|---|
| 1,026,238 | 5/1912 | Anderson | 439/675 |
| 3,568,137 | 3/1971 | Youngblut | 439/879 |
| 4,129,352 | 12/1978 | Iizuka | 439/675 |
| 4,431,254 | 2/1984 | Cartesse | 439/675 |
| 4,580,856 | 4/1986 | Westover et al. | 439/877 |
| 4,593,464 | 6/1986 | Williams et al. | 439/675 |
| 4,630,877 | 7/1979 | Moore | 439/675 |

*Primary Examiner*—David Pirlot

*Attorney, Agent, or Firm*—Armstrong Nikaido, Marmelstein, Kubovcik & Murray

[57] ABSTRACT

A pin plug connector is comprised of a pin, a body which will be connected with the pin by insertion, a cover which will attach over circumferential side of the body, a covered shield line which comprises a core line, a shield line and a cover portion, a terminal which will connect the shield line to the cover, a cap which will fit over assembled components noted above, and wherein improvement is introduced in that the terminal is provided with a press fitter to press-fit the shield line and a clamping end to clamp the cover portion of the line, and an engaging end to engage with the cover, thereby external forces which attempt to pull the shield line will be resonably divided to the connections mounted on the terminal and then a break of connection will be avoided.

4 Claims, 5 Drawing Sheets

PIN PLUG CONNECTOR

FIELD OF THE INVENTION

This invention relates to a pin plug connector which will be advantageously applied to electrical connections in audio devices.

DESCRIPTION OF THE CONVENTIONAL ART

A conventional pin plug connector comprises a pin and a body, made of an insulative material, which will be connected with the pin by insertion thereof, and a cover, made of a metal, which will attach over side wall of the body.

The pin is connected at its one end to a core line comprised in a covered shield line and, with the core line fitted, the pin is inserted into the body.

The cover is customarily shaped in a hollow cylinder and is provided with a clamper which is customarily provided in an extension of the cylindrical wall of the cover, wherein the clamper is adapted to clamp a skin cover portion of the line to be connected and a shield line comprised in the line is customarily bent and clamped by another clamper than the clamper noted above. The body after attached over by the cover is further fitted over by the cap, made of an insulative plastic and shaped in a flaring cylinder.

Referring to disadvantage with conventional pin plugs, fittings of the shield line and the cover portion of the line are formed in different or separated components to be incorporated, which has invited much processing steps and excess cost. Further mechanical resistance to external pull forces exerting to the fittings is not always sufficient.

SUMMARY OF THE INVENTION

This invention relates to a pin plug connector which comprises a pin, a body which will be connected with the pin by insertion, a cover which will attach over circumferential side of the body, a covered shield line which comprises a core line, a shield line and a cover portion, and further featuring inclusion of a terminal which will connect the shield line to the cover, a cap which will fit over assembled components noted above, wherein improvement is made in that the terminal, one component to be assembled, is provided with a press fitter to press-fit the shield line and a clamping end to clamp the cover portion of the line, and an engaging end to engage with the cover.

Whereby resistance to external pull forces due to pulls of the shield line which will act mainly on the cover portion and the shield line assembled to reasonably divided to two fittings mounted on one component of the terminal.

BRIEFING OF THE DRAWINGS

Figure 1:
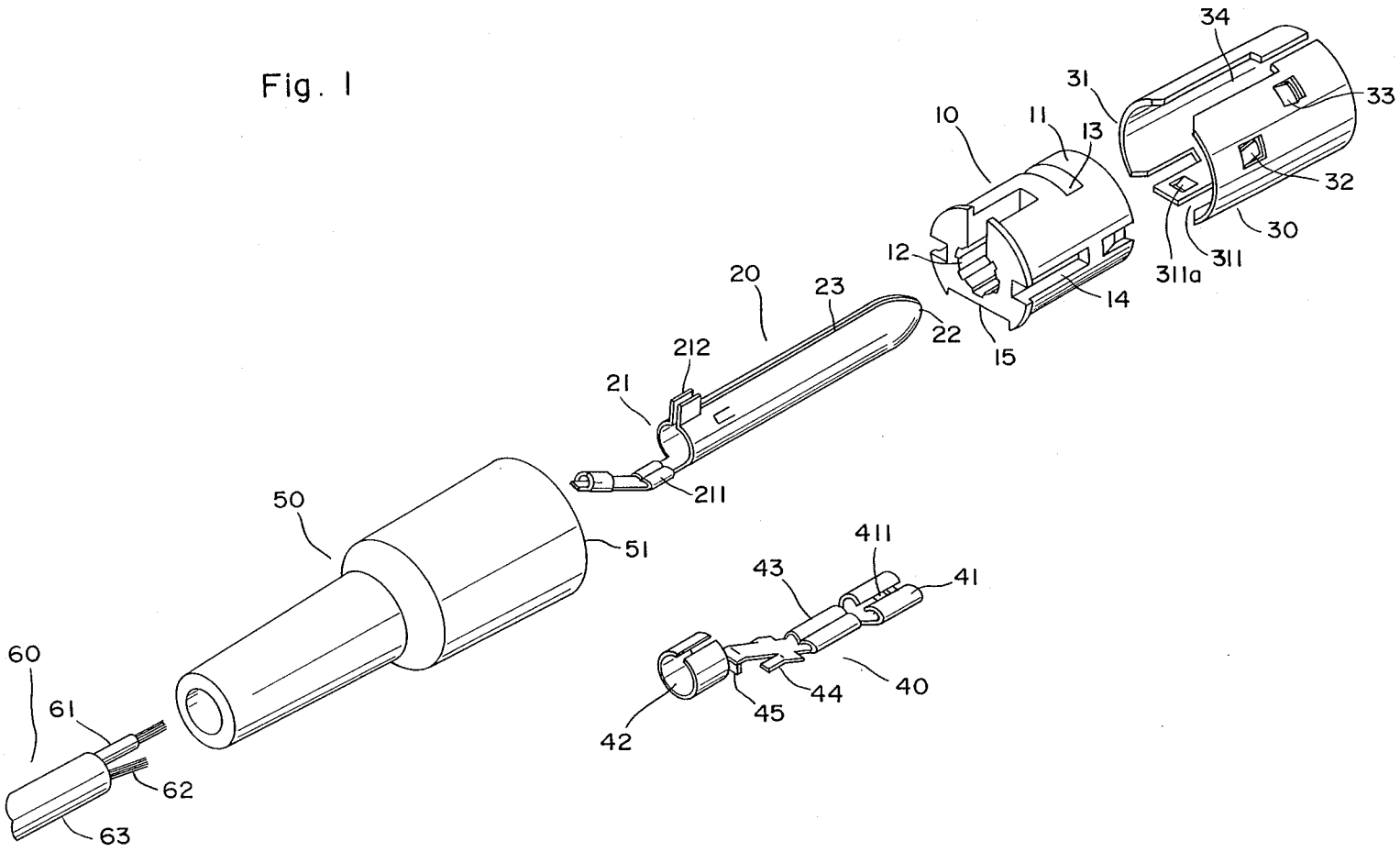
FIG. 1 shows an exploded perspective view of components which will partake to form the inventive pin plug connector.

These drawings are intended to illustrate the invention and therefore these should not be construed as limiting the invention.

DESCRIPTION OF THE INVENTIVE EMBODIMENTS

The invention will be explained in the following with reference to the drawings.

A pin plug of the invention comprises a body 10, a pin 20 which will be secured by being inserted into the body 10, a cover 30 which will fit over a circumferential side 11 of the body 10, a terminal 40 which will connect the cover 30 to a shield line 62, and a cap 50 which will cover these components as noted.

Therein, the body 10 is a component made of a plastic to have elctrical insulation and made in a form of cylinder, wherethrough a through hole 12 is provided axially to receive the pin 20 and a window 30 is formed transversely to communicate from the through hole 12 to the circumferential side 11. And the through hole 12 is sectionaly in a shape of asterisk and is, as viewed in the drawing, provided with a cut to form a upward opening to the up side of the body. A portion indicated by 14 is a groove to engage the cover 20 with the body 10 and a portion by 15 is a groove to engage with the terminal 40.

The pin 20 is a component, made by rounding a metal strip and one end 22 thereof is shaped round and the other end 21 is provided with a press connector 21 which will press-engage with a core line 61 wherein a pair of ribs 212 is formed at such a position as to be seen outside through the window 13 after the pin 20 has been inserted into the body 10 and a portion by 23 is a groove which was caused by the rounding of a metal material to form the pin 20.

The cover 30, made of a metal, is formed to be a hollow cylinder having correspondence in sectional shape to the circumferential side 11 of the body 10 and at one end 31 thereof two parallel cut-ins are formed to give a reed 311, whereon at a centeral portion thereof an angled flap **311*a* is formed outwardly. Further an inwardly angled flap 32 is formed on the side 11 so as to fit with the cut 14 and a similar flap 33 angled outwardly is formed to fit with an end (not shown) of the cap 50 for the purpose of locking the cap 50. In addition, a portion by 34 is a groove to fit with the window 13**.

The terminal 40, made of a metal, is shaped at one end to have an engaging end 41 which will engage to the reed 311 and at the other end to have a clamping end 42 which will clamp the shield line 62 with its tubing cover 63, and at a central portion of the terminal 40, the press fitter 43 is formed. Then, at a central portion of the engaging end 41, an opening 411 is formed to render a tight fitting by receiving the flap **311*a*, and width of the terminal 40 is dimensionally designed to conform with the groove 15, and further portions indicated by 44, 45** are drags or stoppers to lock the terminal itself after incorporated in the pin plug.

The cap 50 is meant to protectively cover the whole pin plug article after assembled and is made of a soft, insulative plastic which is shaped in a flaring cylinder, on whose inside 51 a rib (not shown) is formed so as to fit with the flap 32 to lock the cap 50 itself. The covered shield line 60 comprises a skin cover portion 63, wherein a core line 61 and a shield line 62 are sheathed together, but mutually insulated. Of the two lines, the core line 61 will be press-fitted at the press fitter 211 of the pin 20 to maintain electrical and mechanical connection to the pin 20 and the shield line 26 will be press-fitted at the press fitter 43 of the terminal 40 to maintain electrical and mechanical connection to the terminal 40. Finally, the covered shield line 60 as a whole will be gripclamped at the clamping end 42 of the terminal 40.

Next in the following will be explained the process for assembling a pin plug connector of the invention or an inventive article. The core line 61 is press-connected at the press connector 211 of the pin 20 (see FIG. 2-*a*).

Figure 2A:
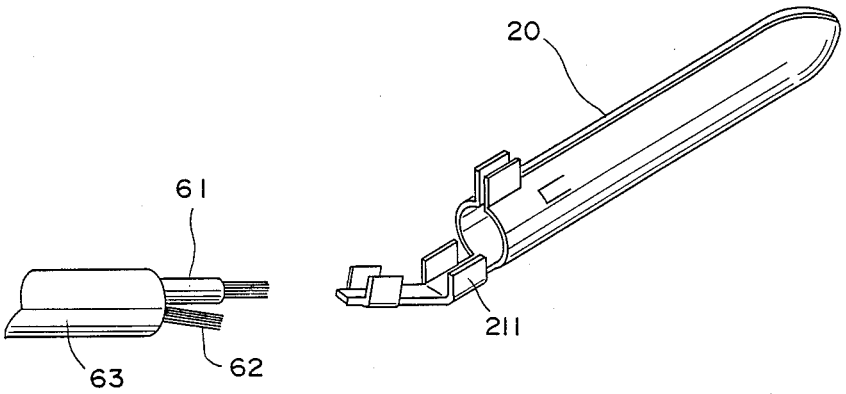
FIG. 2 shows, in a series of A to D, views similar to FIG. 1 to indicate the process of assembling the components as shown in FIG. 1.
Figure 2B:
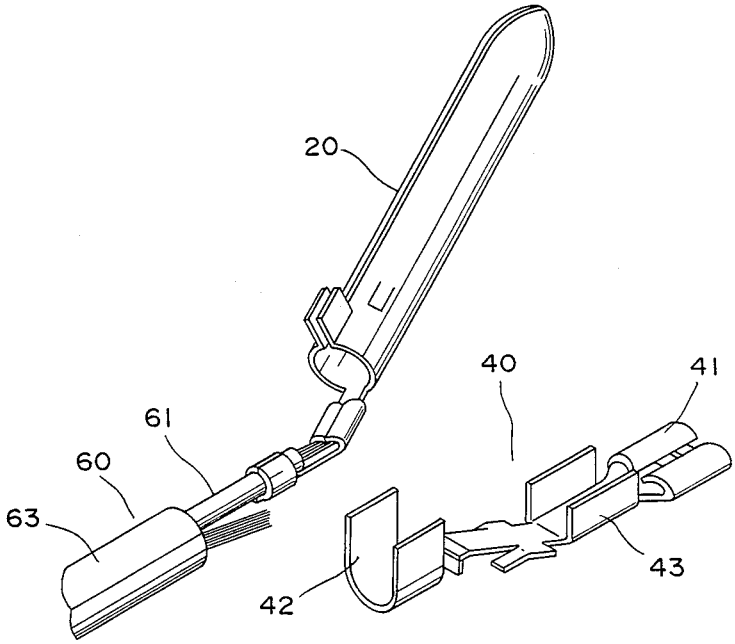
Figure 2:
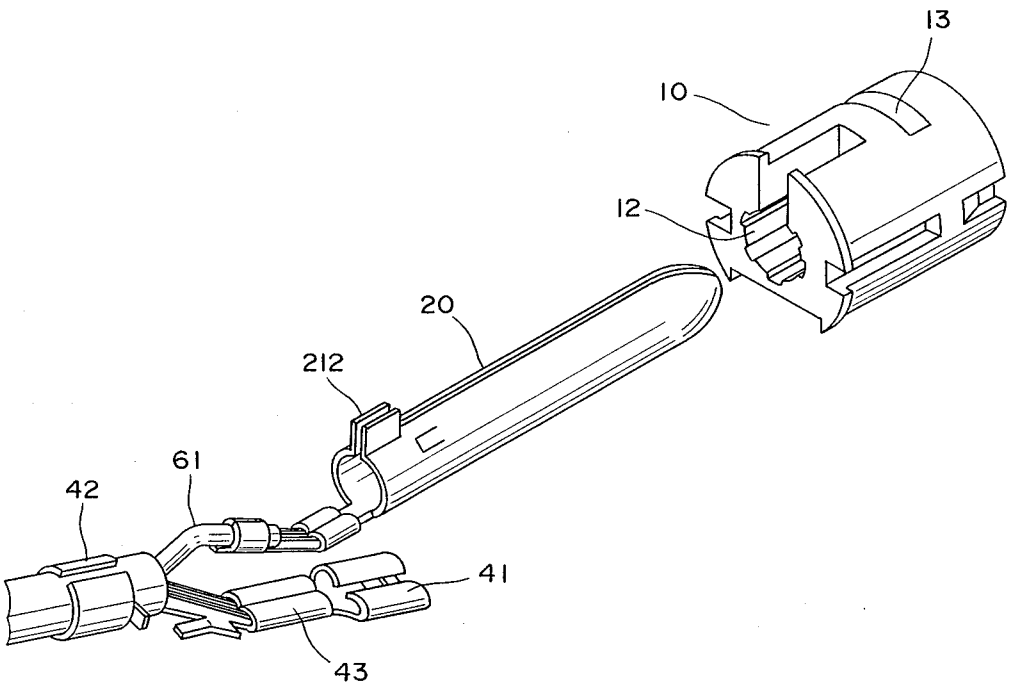
Figure 2:
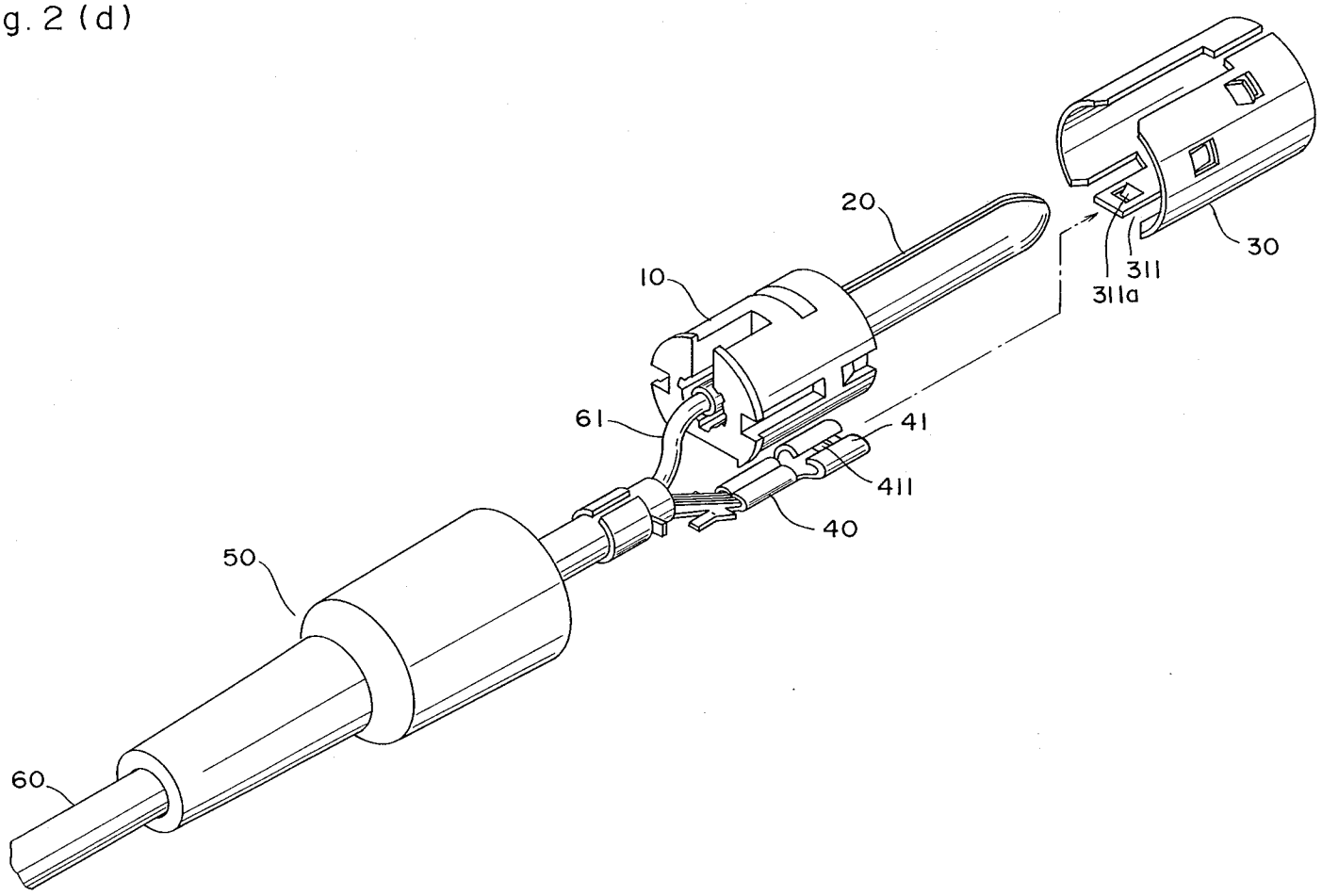
Figure 2E:
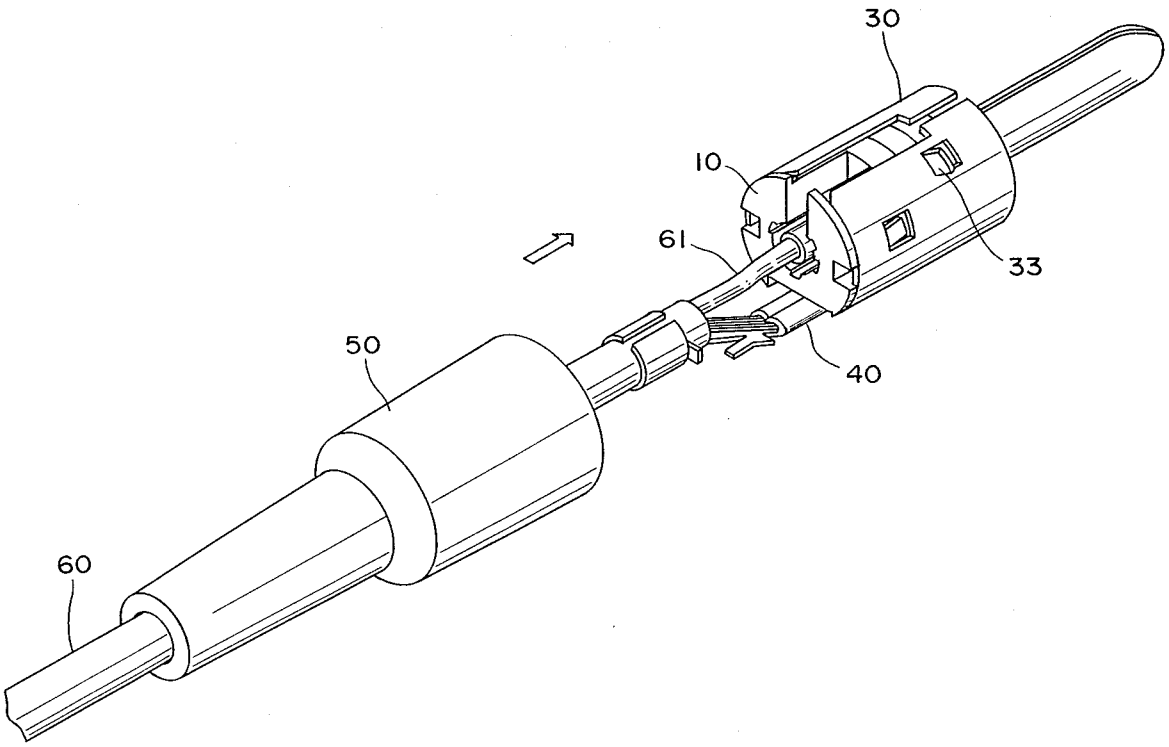

The shield line 62 is press-fitted at the press fitter 43 of the terminal 40 with clamping the cover portion 63 of the line 60 by the clamping end 42 (see FIG. 2-*b*).

The pin 20 which has been connected to the core line 61 is inserted, with the end 22 ahead, into the through hole 12 of the body 10 until the ribs 211 come to register with the window 13 and then the ribs are bent to form a drag. Thus, the pin 20 is connected with the body 10 (see FIG. 2-*c*).

The body 10 which has been integrated with the pin 20 is attached over by the cover 30 with engaging the terminal 40 into the groove 15 and further to make engagement of the engaging end 41 of the terminal 40 with the reed 311 of the cover 30 wherein the opening 411 is subjected to drag with the angled flap 311*a*. Thus the terminal 40 is connected with the cover 30 (see FIG. 2-*d*).

Then the cap 50, which has been penetrated by the line 60 initially, is not put into fit-over service for assembled components as noted, wherein the components are pushed each other so that further compactization will take place, thereby the flap 33 of the cover 30 is engaged to the rib in the cap (not shown) and thus the cap 50 is fitted to cover the body 10 (see FIG. 2-*e*).

As explained above, the invention is featured in that, after the core line 61 is press-connected to the pin 20, apart from the pin sidewise, the shield line 62 is press-fitted on the terminal 40 and the cover portion 63 is clamped by the same terminal 40, and terminal 40 and the cover 30 are firmly connected by the drag engagement between the opening 411 and the angled flap 311*a*. Thus mechanical and electrical characteristics are enhanced and reduced favorably are processing steps in assembling of the components.

We claim:

1. A pin plug connector for an electric cable having a core line, a shield line, and a cover portion for covering said lines, comprising:

a cylindrical pin having a press connector at one end thereof for connecting said core line thereto;

a terminal for connecting said shield line, said terminal having a clamping end at one end thereof for clamping said cover portion, a slidably detachable first engagement element at the other end thereof and a press connector between said clamping end and said first engagement element;

a substantially cylindrical unitary insulating body provided with a through hole along a central axis thereof and a circumferential surface, said through hole having an inner diameter substantially equivalent to an outer diameter of said cylindrical pin; and a cylindrical conductive unitary cover slidably and detachably covering said insulating body, said cylindrical conductive unitary cover having a length longer than that of said unitary insulating body and having a slidably detachable second engagement element at one end thereof for receiving said first detachable engagement elements of said terminal.

2. The pin plug connector according to claim 1, wherein a cut-off groove is provided at one end of said circumferential surface of said insulating body, and further wherein said cover and said insulating body are provided with a detachable engagement means for firmly engaging together.

3. The pin plug connector according to claim 1, wherein said second engagement element is a substantially rectangular tongue.

4. The pin plug connector according to claim 3, wherein said substantially rectangular tongue is provided with an angled flap.

* * * * *